United States Patent [19]

Colson

[11] Patent Number: 4,862,941

[45] Date of Patent: Sep. 5, 1989

[54] VERTICAL SHADE ASSEMBLY

[75] Inventor: Wendell Colson, Boulder, Colo.

[73] Assignee: Hunter Douglas Inc., Upper Saddle River, N.J.

[21] Appl. No.: 108,507

[22] Filed: Oct. 6, 1987

[51] Int. Cl.[4] ..... E06B 3/94

[52] U.S. Cl. ..... 160/84.1; 160/279; 160/285

[58] Field of Search ..... 160/84.1, 279, 285, 160/287, 206, 188

[56] References Cited

U.S. PATENT DOCUMENTS

| | | | |
|---|---|---|---|
| 718,992 | 1/1903 | Emery | 160/279 X |
| 3,509,934 | 11/1968 | Smart . | |
| 3,708,009 | 1/1973 | Viol et al. . | |
| 4,473,101 | 9/1984 | Langeler . | |
| 4,647,488 | 3/1987 | Schnebly et al. . | |
| 4,673,018 | 6/1987 | Judkins | 160/84.1 |
| 4,687,038 | 8/1987 | Clemente | 160/84.1 |

FOREIGN PATENT DOCUMENTS

| | | |
|---|---|---|
| 0220074 | 4/1987 | European Pat. Off. . |
| 6508988 | 7/1967 | Netherlands . |

*Primary Examiner*—Blair M. Johnson

*Attorney, Agent, or Firm*—Pennie & Edmonds

[57] ABSTRACT

A vertical shade assembly extendable and retractable in a horizontal direction and including a pleated shade member suspended from an upper traversing track, a shade guide mechanism extending through the assembly, and a braking mechanism operatively connected to the shade guide mechanism for creating a braking force to hold the shade member against movement.

29 Claims, 5 Drawing Sheets

FIG. 1
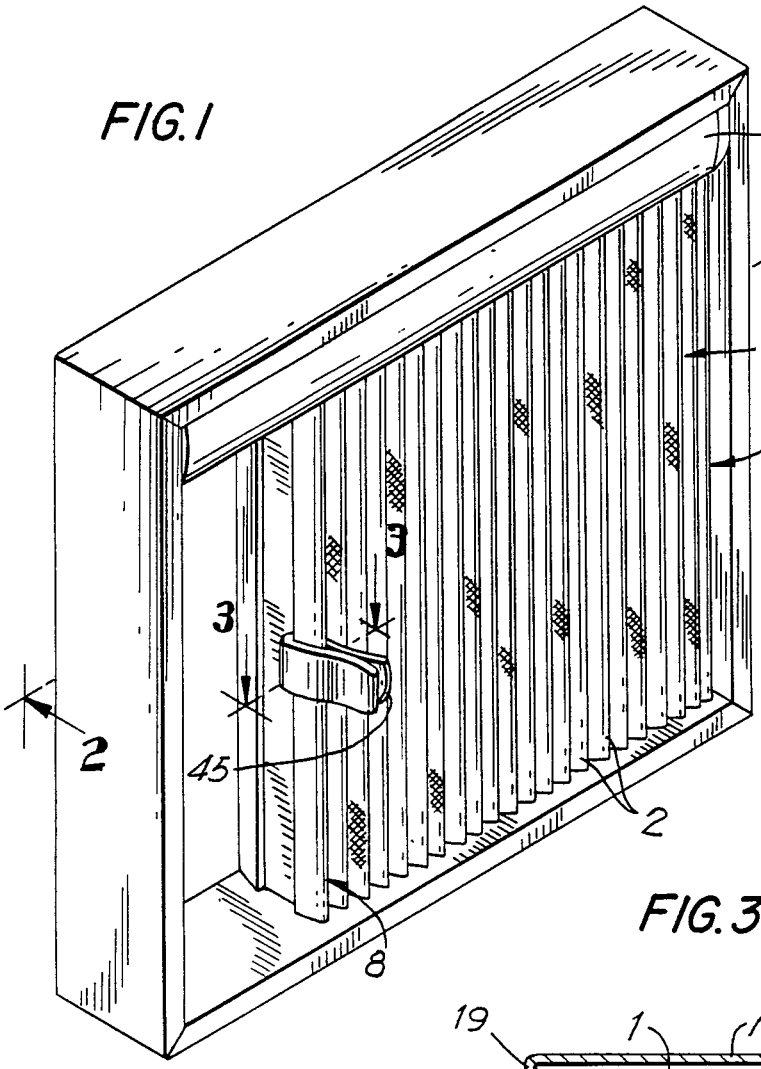
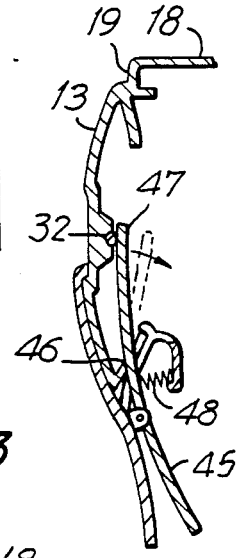
FIG. 3
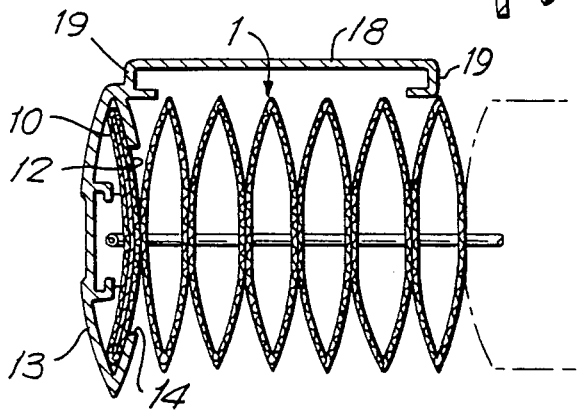
FIG. 4

VERTICAL SHADE ASSEMBLY

BACKGROUND OF THE INVENTION

The present invention relates to an extendable-retractable pleated shade assembly such as used for covering windows or doors with the shade moving in a horizontal direction between extended and retracted positions.

With sliding glass doors functioning both as a window and a door, it is sometimes desirable to provide appropriate shading. Because a sliding door moves in a horizontal direction, it is also desirable to have the shade move in a similar direction. In this way the shade does not have to be moved to its completely retracted condition before entering or exiting the open door. It is also desirable in some situations to have windows provided with shades that extend and retract in a horizontal direction. This is so whether the windows open and close by horizontal movement or vertical movement or are simply comprised of a fixed glass with no opening capability.

Horizontally moving shade constructions are presently available. These assemblies, however, have certain disadvantages as, for example, limitations on their size or they require complicated tracking and control mechanisms for operating the shade.

An example of a horizontally moving shade construction is disclosed in European Patent Application, Publication No. 0,220,074, published Apr. 29, 1987. This European patent application discloses many variations of vertical shade assemblies adapted to extend and retract in a horizontal direction. The assemblies include shade members comprised of slats extending vertically, single pleats extending vertically or double pleats forming honeycomb cells which extend vertically. All of these constructions include upper track assemblies and connecting means for the shade to facilitate hanging from the track and horizontal movement therealong. In addition, these assemblies include guide cord arrangements for guiding the horizontal movement of the shade. With the constructions disclosed in this application, weights are connected to the ends of the guide cords to provide a driving force in one direction. This, in turn, requires separate braking means to hold the shade in an extended or partially extended position. The weight arrangement in these constructions is such that the weight is free to move vertically along one lateral end of the shade. The vertical movement of the weight is, of course, normally limited to the vertical height of the shade. This in turn can place limitations on the horizontal movement of the shade as its horizontal movement from one extreme to the other must be within the vertical movement of the weights. Otherwise, these weights would become inoperative.

U.S. Pat. No. 4,647,488 granted Mar. 3, 1987 also discloses a shade assembly which can be used in the vertical orientation with the pleats of the shade extending vertically and the shade itself moving horizontally between extended and retracted positions. Such an arrangement is shown in FIGS. 25 and 27 of the patent. With this construction, the side edge seal elements, shown in FIG. 27, become oriented above and below the assembly when turned 90° to the position shown in FIG. 25. Also, in the position of FIG. 25, the hanging of the blind is from one side rather than from an overhead track. This can produce an unbalanced type of assembly the further the blind is moved horizontally away from its point of hanging. Also, the lower edge seal element can be unsuitable with sliding doors because of its exposure to damage by people passing through the door.

The construction of the shade assembly shown in FIG. 27 of U.S. Pat. No. 4,647,488 also includes a double cord assembly extending through the shade whereby the movement between extended and retracted positions of the shade can be controlled by moving the movable end of the shade in the desired direction. There is, however, no provision made in this cord assembly for braking the movement of the shade so that it will stay in any position between fully extended and fully retracted conditions. This apparently is not a problem with the construction shown in FIG. 27 of the patent due to all the frictional contact between the shade and the associated structure which tends to hold the shade in any particular position.

With a vertical shade assembly, however, where the shade is hung from an overhead track and moved horizontally without any sealing elements as in the '488 patent and with the bottom edge of the shade free of any external sealing or guide structure, the pleated construction of the shade is known to have a normal tendency to collapse to its retracted position with the cells or pleats of the shade closed against each other. For example, if the width to be covered by the assembly were 6 to 8 feet, the shade may find a normal stable position with a third to a quarter of the opening covered by the shade.

U.S. Pat. No. 4,473,101 granted Sept. 25, 1984 discloses a shade assembly having a cord guiding system permitting positioning of the shade in any desired position. In the assembly disclosed in this patent, the cord guiding system is routed through the assembly with right angled turns and the cord is maintained taut in order to retain the shade in the desired position of openness. This construction further includes side guide tracks which are required to maintain the shade in the alignment within its mounting structure. The side guide structure is further required for routing the cord guide system.

Use of the shade assembly disclosed in the '101 patent for horizontal movement between opened and closed positions would require a guide track along the bottom of the assembly subjecting this member to possible damage. Also the shade member of the assembly would be secured at one side rather than from above thus creating an unbalanced system the further the shade is moved from its support.

SUMMARY OF THE PRESENT INVENTION

In accordance with the teachings of the present invention, applicant has developed a vertical shade assembly incorporating a shade guide mechanism which is admirably suited for controlling horizontal operation between extended and retracted conditions of the shade. The guide mechanism also neatly maintains the shade in proper alignment as it is moved between extended and retracted conditions. The shade guide mechanism is routed through the shade assembly in such a manner as to function as part of a braking system for maintaining the shade in any desired location between fully extended and fully retracted positions. Furthermore, no weights, as used in prior art constructions, are required. Thus, there is no resulting limit to the extent of horizontal movement of the shade.

The shade assembly of the present invention also includes a tracking system which facilitates smooth horizontal movement of the shade between extended and retracted conditions without binding along the track. The shade guide mechanism of the present invention functions in conjunction with this tracking system to maintain it properly aligned to assure the smooth non-binding movement.

With the present invention, the assembly can be constructed for manual operation through manipulation of the moving lateral end of the shade. Alternatively, operation can be controlled through a motor drive mechanism or through an external cord system. The embodiments include a braking mechanism operating in conjunction with and controlled by the shade guide mechanism.

BRIEF DESCRIPTION OF THE DRAWINGS

FIG. 1 is a perspective view of the vertical shade assembly of the present invention;

FIG. 3 is a cross-sectional view taken along lines 3—3 of FIG. 2;

FIG. 4 is a cross-sectional view taken along lines 4—4 of FIG. 2;

DETAILED DESCRIPTION OF THE PREFERRED EMBODIMENTS

Figure 2:
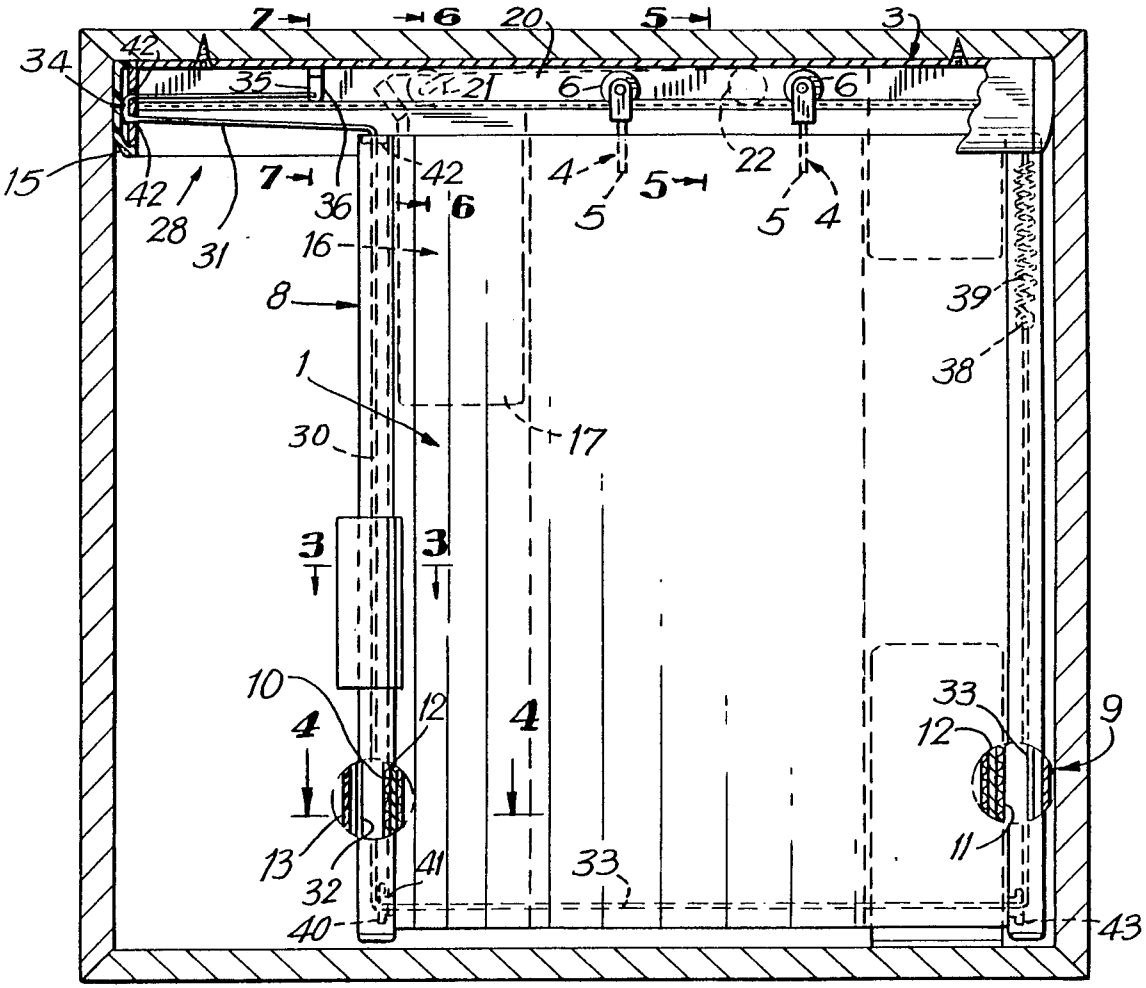
FIG. 2 is a side view partially in cross-section of the shade assembly of the present invention.

As shown in FIGS. 1, 2 and 4, the pleated shade assembly of the present invention includes a pleated shade member generally designated at 1 and having vertically positioned pleats 2. The shade member is movably suspended in a vertical plane from an upper traversing track 3, more clearly shown in FIG. 5. The shade member shown in FIG. 4 is a double pleated construction defining superimposed honeycomb cells such as disclosed in Colson U.S. Pat. No. 4,450,027. The shade can also be a single pleated or other construction.

The shade member is hung from the traversing track 3 by carrier members 4. These carrier members include a clip type of connector 5 at their lower ends for attachment to the pleated shades at intervals along its width. At its upper end each carrier has a roller 6 which is adapted to ride on a track section 7 of the traversing track 3.

Vertical supports 8 and 9 are connected to the opposite lateral ends 10 and 11 of the shade member 1. As shown most clearly in FIG. 4, the lateral end 10 of the shade member is defined by the last honeycomb cell structure. Internally of this cell structure, a stiffener member 12 is disposed. The vertical support 8, on the other hand, includes an elongated housing 13 extending between the upper and lower ends of the support. The housing has an opening 14 which is narrower than the width of the stiffener 12. With this construction, the last cell structure with the stiffener 12 contained therein can be slid into the housing 13 to releasably secure the lateral end 10 of the pleated shade member to the vertical support 8. This same arrangement is used to secure the other lateral end 11 of the shade member to the other vertical support 9.

In the construction shown in FIGS. 1 and 2, the lateral end 10 together with the vertical support 8 is adapted to move horizontally between a first position generally aligned with the left hand end 15 of the traversing track and spaced from the vertical support 9 to a second position adjacent the vertical support 9. In the first position the shade is in a fully extended condition whereas in the second position, it will be in a fully retracted condition. In the construction shown in FIGS. 1 and 2, the vertical support member 9 is fixed against movement.

Figure 8:
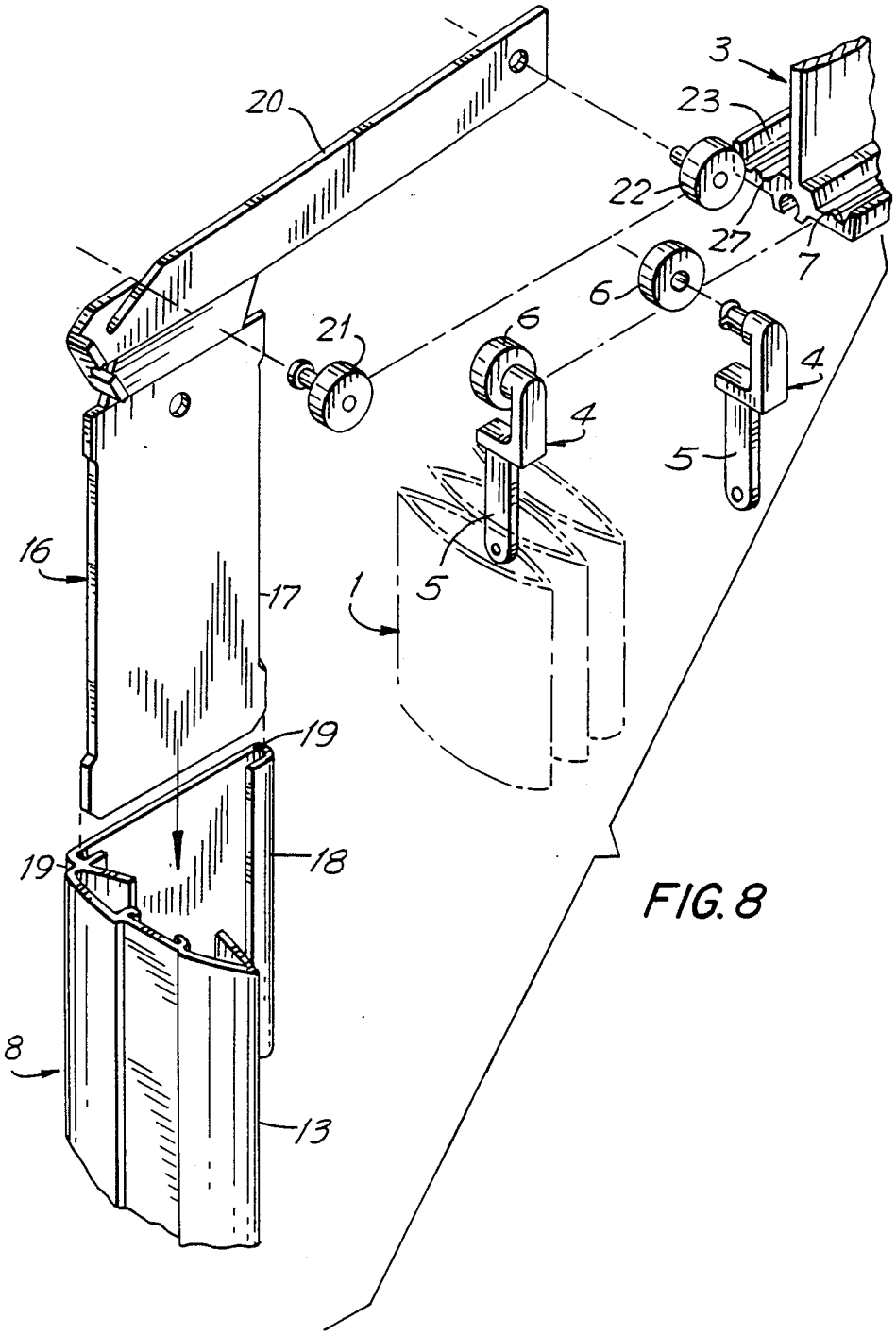
FIG. 8 is an exploded view showing the bracket means for connecting the shade member to the traversing track in the assembly of the present invention.

The movable vertical support 8 is slidably connected to the traversing track for movement in the horizontal direction. For this purpose, a bracket 16 is provided. This bracket has a first section 17 connected to the upper end of the vertical support 8. This connection is through a sliding fit of the end section 17 into a side flange 18 formed on the vertical support 8. As shown in FIG. 8, this side flange 18 includes two end flanges 19 spaced from the outer central wall of the flange. The spacing is such as to accommodate the one end section 17 of the bracket 16. The fit between these members can be a friction fit or the members can be pinned or otherwise secured in assembled condition.

The bracket 16 includes a second section 20 extending at right angles to the first section 17. This section, when connected to the traversing track, extends along the track and includes two rollers 21 and 22 providing track engaging means for the track section 23 of the traversing track. See FIGS. 5, 6 and 8. The rollers 21 and 22 are spaced from each other along the traversing track. The roller 21 is generally located adjacent the upper end of the vertical support 8 while the second roller 22 is located between the first roller 21 and the second support 9.

Figure 5:
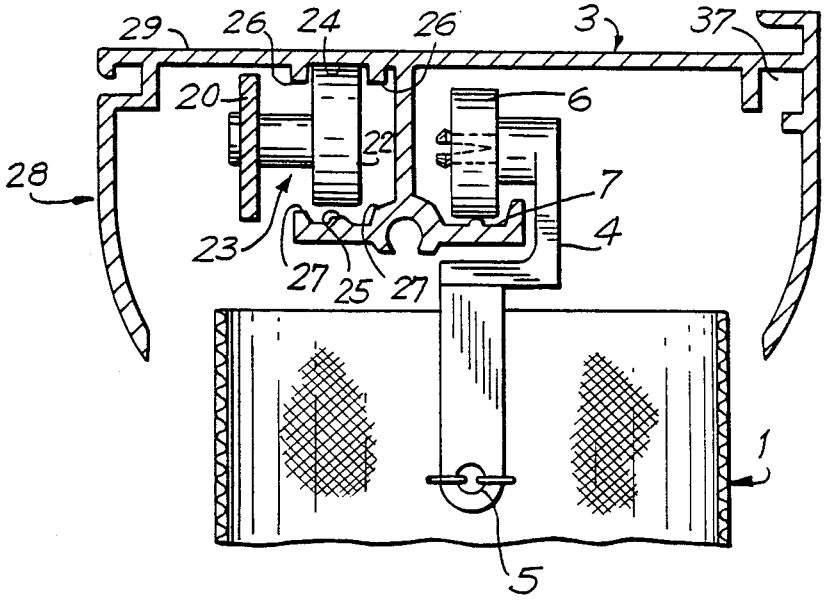
FIG. 5 is a cross-sectional view taken along lines 5—5 of FIG. 2.
Figure 6:
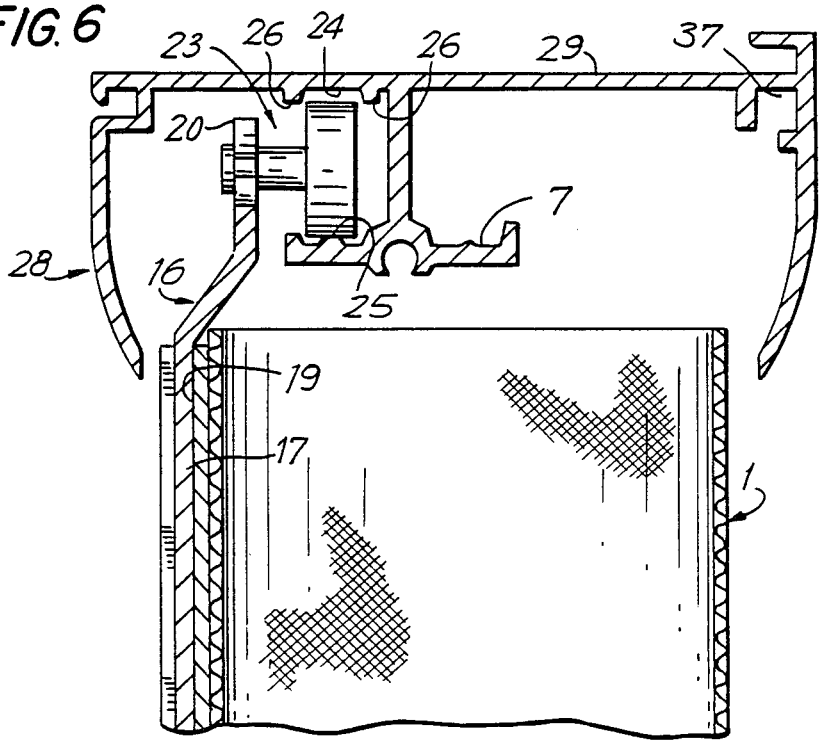
FIG. 6 is a cross-sectional view taken along lines 6—6 of FIG. 2.

With reference to FIGS. 5 and 6, it will be seen that the track section 23 includes an upper guide track 24 facing downwardly and a lower guide track 25 facing upwardly in alignment with the upper guide track. Also, both the upper and lower guide tracks include side guides 26 and 27, respectively. These side guides constrain lateral movement of the rollers 21, 22 as they move along the guide track section 23.

FIGS. 5 and 6 show the traversing track as incorporated internally of the upper rail member 28 of the shade assembly. This rail member is adapted to be secured to an upper horizontal support or frame structure of the opening with which the assembly is to be associated. Both tracking sections 7 and 23 depend from the upper wall section 29 of the upper rail. The entire rail structure and the traversing track can all be formed as a single extrusion.

The shade assembly of the present invention also includes a unique shade guide means extending through the assembly. As shown in FIG. 2, the shade guide means is defined by a cord 30. This cord is of the usual construction used with shade assemblies in that it has minimum stretch characteristics. It is to be understood, however, that other shade guide means such as steel cables or elastic cords or other suitable constructions can be used. In accordance with the teachings of the present invention, the guide cord is routed through the shade assembly in such a way as to simultaneously produce a number of different functions, as explained below.

The cord guide means includes a first end section 31, a central section 32 and a second end section 33. The central section extends in movable relationship through the vertical support 8 whereas the first and second end sections extend away from the vertical support 8 in opposite directions as measured along the traversing track and in the direction of horizontal movement of the shade member.

More particularly, the first end section 31 extends away from the support 8 at a location at the upper end thereof. This first end section extends to the left end 15 of the traversing track corresponding to the position of the moving vertical support 8 in the fully extended condition of the shade member. The first end section then extends through a cord guide 34 attached to the left end of the upper rail 28 and reverses direction along the traversing track to its terminal end 35.

Figure 7:
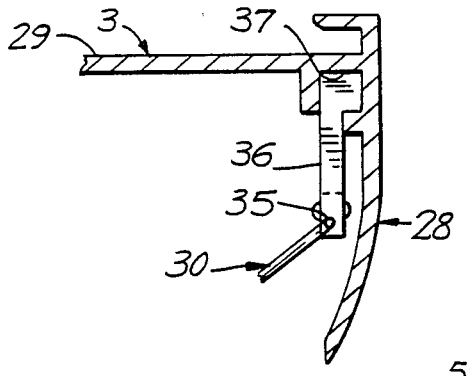
FIG. 7 is a cross-sectional view taken along lines 7—7 of FIG. 2.

At its terminal end it is connected to one end of a tension adjuster connector member 36, the other end of which is mounted in a tension adjuster track section 37. See FIG. 7. This track section extends along the traversing track in the same direction as the track sections 7 and 23. The connector member 36 is mounted in the track section 37 for selective movement therealong to adjust the tension in the cord as more fully described below. The connector member 36 is held in any selective position along the track 37 due to twisting within the track. More particularly, the end of the connector mounted in the track is fit such that when any load is applied to the other end of the connector 36, it causes the connector to cast and jam within the track section 37.

The second end section 33 of the shade guide cord extends away from the vertical support 8 at its lower end and is directed along the lower half of the shade member from the support 8 to the second position the support will assume when the shade member is moved to its fully opened position. With the embodiment of FIG. 1, this position will be with the movable support 8 located adjacent the second stationary support 9. The second end section of the guide cord is then passed through the lower end of the second support 9 and secured at its terminal end 38 to one end of a tension spring 39. The other end of the spring is attached to the stiffener 12 contained within the vertical support 9 and to which the last cell of the pleated shade is attached.

For guiding the cord through the shade assembly, cord guides are provided in both vertical support members. More particularly, in the movable support 8 a cord guide 40 is attached to the lower end of the stiffener 12. This cord guide can be of any suitable construction having a central cylindrical section 41 extending through a complementary hole in the stiffener. At the upper end of the movable support 8, an additional cord guide 42 is provided. This cord guide 42 can be in the form of an end cap for the vertical support. Continuing in this direction, the end section of the cord passes through the cord guide 34 connected at the end 15 to the top rail 28. This cord guide includes two openings through which the cord end section 31 passes so as to reverse its direction.

The other section 33 of the cord after it leaves the lower end of the vertical support 8 through the cord guide 40 passes through holes in the central portions in each of the cells of the pleated shade. This passage is at the lower end of the shade and internally of the cell structures and is, therefore, not visible. The lower end of the shade is otherwise free of any structure. At the lower end of the stationary vertical support 9, a cord guide 43 is provided. The construction of this cord guide is the same as the cord guide 40 and it is similarly attached to the bottom end of the stiffener 12 contained within the support 9. After leaving the cord guide 43, the terminal end 38 of the cord is, as mentioned above, attached to the tension spring 39.

With the construction shown in FIGS. 1 and 2, the connector member 36 of the tension adjuster will be slid along the tension adjuster track section 37 until the cord extends in a taut condition between the first and second end sections. This is easily facilitated by the tension spring 39. The tension adjuster is moved to the right as viewed in FIG. 1 until this spring 39 is under slight tension. Although the construction shown in FIGS. 1 and 2 includes a tension spring, it can be eliminated and the cord placed in taut condition by securing its terminal ends against movement. This in turn can be done by securing the terminal end 38 of the cord directly to the stiffener. With this construction, the movement of the tension adjuster to create tautness will be over a very small distance, using the conventional no stretch cord normally used by shade assemblies. This construction can, however, create the possibility that the cord will be moved beyond its breaking point in trying to get the proper tautness. The tension spring 39 avoids this problem. In this regard, it will be noted that the tension spring is not an active spring in the sense that tension is increased as the shade is moved in the direction towards its extended position. The spring simply maintains proper tautness of the cord throughout the system.

The cord tautness is shown in FIG. 2 with the cord generally extending in straight taut lines between the points of turning at the cord guides. More particularly, the first section 31 extends in generally a straight line between the upper end of the support 8 and the left end 15 of the traversing track. Similarly, the central section 32 of the cord extends in a straight line between the upper and lower ends of the vertical support 8. With respect to the other end section 33 of the cord, it extends in a straight line between the lower ends of the two supports 8 and 9 and in a straight line between the lower end of the support 9 and its terminal end 38. With this construction, movement of the vertical support 8 in a horizontal direction shifts the support along the guide cord. For example, when the vertical support 8 is moved from the position shown in FIG. 2 to the right or open position of the shade, the guide cord enters the lower end of the moving support 8 and exits at the upper end of this support. The reverse relative movement occurs when the vertical support 8 is moved to the left as viewed in FIG. 2.

In accordance with the teachings of the present invention, a braking means is provided for holding the movable support 8, and thus the shade member 2, in any position between fully retracted conditions. With the construction shown in FIGS. 1 and 2, this braking force is provided by the cord guide means operating in conjunction with the tautness of the cord. In particular, the guides 40 and 42 at the lower and upper ends of movable vertical support 8 provide frictional engagement of the cord therewith when the cord is maintained taut. This frictional engagement is sufficient to hold the shade member in any selected position along the traversing track. If this tautness in the guide cord is eliminated, the friction at the cord guides 40, 41 would also be eliminated and the normal tendency of the pleated shade member to collapse will take over. This in turn will urge the shade member toward its open position. With the construction just described, it will be evident that the braking means is operatively connected to the shade guide cord and is an inherent part of the shade guiding means as opposed to being a separate braking mechanism as is typical of the prior art constructions.

In conjunction with this braking system as just described or independently thereof, as for example, in situations where cord tautness is not practical or desired, a releasable brake can be employed. This releasable brake is shown in FIG. 3 as incorporated into a handle structure 44 attached to the movable support 8. This releasable brake handle is mounted at a convenient height along the vertical support and includes a lever member 45 extending through an opening 46 in the housing 13 of the support. The internal half of the lever 45 includes a brake 47 which is normally held in brake clamping engagement with the central section 32 of the cord by means of a spring 48. This clamping engagement is sufficient to hold the movable support 8 against movement along the central section 32 of the cord. When it is desired to move the shade member toward an extended or retracted position, the person grabs the handle and lever and squeezes them together. The lever acts as a brake releasing means to release the brake and permit the operator to exert a moving force on the handle to thus effect adjustment of the position of the shade member.

With the construction shown in FIGS. 1 and 2, the taut guide cord, by extending in opposite directions away from the upper and lower ends of the support 8, urges the support into a pivoting mode in the plane of the shade member. This cord action also urges the bracket 16 into a pivoting mode to advantageously bias the rollers 21 and 22 into moving engagement with their cooperating track sections. In particular, the lower end of the movable support 8 is urged to the right and the upper end to the left. This will bias the roller 22 into engagement with the upper guide track 24 and the roller 21 into engagement with the lower guide track 25. With this arrangement, the rollers are snugly held on the traversing track. This together with the side guides of the track sections enhances the smooth operation of the system.

Figure 9:
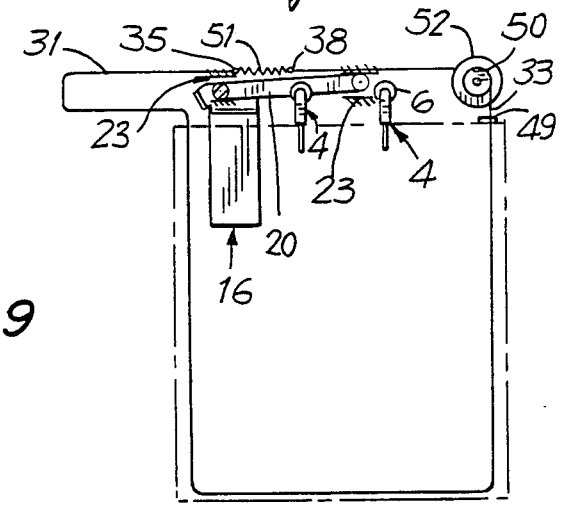
FIG. 9 is a schematic view showing a modified embodiment of the shade guide and braking means of the shade assembly of the present invention.

FIG. 9 shows an alternative embodiment of the invention in which the movement of the shade member can be controlled by a motor. In this embodiment, the second end section 33 of the shade guide cord is directed out the upper end of the support 9 by way of the cord guide 49. The cord end section is then directed around a drive pulley 50 and secured at its terminal end 38 to the other terminal end 35 of the cord by way of a tension spring member 51 to form a closed cord loop. This tension member can either be a spring similar to the tension spring 39 or a piece of elastic cord. As with the construction shown in FIGS. 1 and 2, the tension member 51 can be eliminated and the terminal ends 35 and 38 of the cord can be connected directly to each other.

A suitable motor 52 is provided for selectively driving the pulley 50 in either direction to move the cord loop in either a clockwise or counterclockwise direction along its routing through the shade assembly. Braking is provided through the operative connection of the cord wrapping around the pulley 50 of the motor. This can be a friction engagement preventing movement except when the motor is actuated. With this construction, the movable support 8 can be tightly secured to the central section of a cord to assure against unwanted movement of the shade member in the opening direction. This connection will not normally be necessary provided the cord is maintained in taut condition through the system. In this case, movement of the shade member can be effected either manually through the support 8 or by way of actuating the motor 52.

Figure 10:
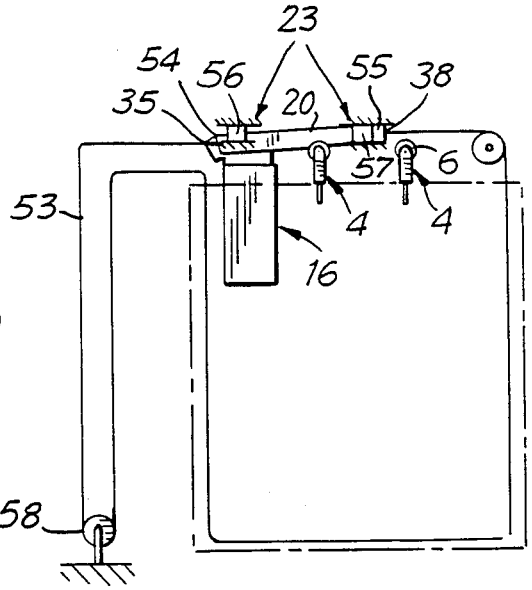
FIG. 10 is a schematic view showing another embodiment of the shade guide and braking means of the shade assembly of the present invention.

A third embodiment of the invention is shown in FIG. 10. In this embodiment, an external cord loop section 53 is provided. The terminal ends 35 and 38 of the cord are connected to the opposite ends 54 and 55 of the section 20 of the bracket 16. The bracket can in turn include slide members 56, 57 instead of the rollers 21, 22 shown in FIG. 8. With this construction, the slide members will move smoothly along the track section 23 when the moving force is exerted in a direction aligned with this track. With the terminal ends of the cord attached to the opposite ends of the bracket section 20 and extending in opposite directions along the track, this alignment will occur. Thus, pulling on either part of the loop section effects sliding movement of the bracket along the track.

When, however, this moving force is released, the tendency of the shade member to move to its retracted position, due to the normal tendency of the cell structure to collapse, will cause the movable support 8 together with the bracket 16 to pivot in a counterclockwise direction as viewed in FIG. 10. This is because the moving force is not applied in alignment with the traversing track but occurs along the full height of the shade member. This pivoting movement will jam the slide members 56 and 57 in the track section 23 and thus immediately hold the shade member in its desired position.

The slide members 56 and 57, which function in conjunction with the track section 23 as a braking means, are operatively connected to the cord guide whereby pulling and releasing of the loop section 53 operates to release and activate the braking mechanism. Thus, as with the other embodiments of the present invention, no external braking mechanism is required.

As with the motor driven embodiment of the invention, using the external cord loop section as shown in FIG. 10, still permits operation of the shade member by actuation of the movable vertical support 8. All that is necessary is that the guide cord be maintained in taut condition between the first and second end sections. With the construction of FIG. 10, this can be achieved by securing the bottom end of the loop section 53 to a tension roller 58. With this construction, the roller engaging means 21, 22 can be retained since the braking force is created due to the tautness of the cord causing frictional engagement at the various cord guides. The jamming of the bracket 16 in the traversing track is no longer necessary nor desirable.

With the cord guide system of FIG. 10 using the slide members 56, 57, the tension pulley 58 is no longer necessary. Also, with this arrangement the moving support 8 is preferably secured to the central section 32 of the cord to assure against inadvertent collapsing of the shade member to the open position.

I claim:

1. The improvement in a pleated shade assembly extendable and retractable in a horizontal direction and comprising a pleated shade member with vertically positioned pleats movably suspended in a plane from an upper traversing track, a first vertical support having upper and lower ends and connected to one lateral end of said shade member, a second vertical support connected to the opposite lateral end of said shade member, bracket means connected to said first support and movably supported on said traversing track for movement therealong to move the first support horizontally along said track between a first position spaced from the second support with the shade in an extended condition and a second position adjacent thereto with the shade in a retracted condition, and shade guide means characterized in that the shade guide means includes:

(a) a central section translatably extending through said first support whereby said first support can be moved in a direction toward or away from said second support;

(b) a first end section extending away from the first support at a location at least adjacent the upper end thereof, said first end section extending to a first end of said track adjacent said first position along said track;

(c) a second end section extending away from the first support at a location at least adjacent the lower end thereof, said second end section being directed along the lower half of the shade member from said first support to said second support; and (d) braking means operatively connected to said first support means for exerting a braking force between said shade guide means and said first support to hold said first support in any position between said first and second positions when not under the influence of said moving force.

2. The improvement in a pleated shade assembly according to claim 1, wherein:

(a) said central section of the shade guide means extends in movable relationship through said first support, allowing movement of the first support therealong upon exerting of a moving force on said first support; and (b) the means for creating a braking force includes:

(1) first and second members for directing said shade guide means, located at least adjacent the upper and lower ends, respectively, of the first support, for directing said first and second end sections of said shade guide means away from said first support, and (2) tensioning means for holding said shade guide means in tension between the first and second end sections thereof and in frictional engagement with said members for directing.

3. The improvement in a pleated shade assembly according to claim 1, wherein:

(a) the first and second end sections of said shade guide means are connected to each other to form a closed shade guide loop; and (b) one of said end sections is drivingly connected to a drive means for selectively moving said shade guide loop in clockwise and counterclockwise directions.

4. The improvement in a pleated shade assembly according to claim 3, wherein:

(a) said braking means for creating a braking force includes:

(1) means for connecting said one end section of the shade guide means to the drive means against movement independently of actuation of said drive means.

5. The improvement in a pleated shade assembly according to claim 4, wherein:

(a) the second end section of the shade guide means extends from the lower end of the first support, through the lower end of the second support, out through the upper end of the second support and along the traversing track and is connected to said drive means and then to the first end section of the shade guide means; and (b) the terminal ends of the end sections of the shade guide means are connected to each other through a tension spring means for maintaining the shade guide means in taut condition throughout the shade guide loop.

6. The improvement in a pleated shade assembly according to claim 1, wherein:

(a) said bracket means includes:

(1) a first section connected to the upper and of the first support, (2) a second section extending along the traversing track, and (3) track engaging means on the second section of the bracket means, (b) said shade member has a normal tendency to move in one direction between said extended and retracted conditions to urge said first support and bracket to pivot about the upper end of said first support in the plane of said shade member and to bias said track engaging means into locked engagement with said traversing track, whereby said track engaging means and said track further define said braking means; and (c) the end sections of the shade guide means are connected to the second section of the bracket means and extend in opposite directions away from said bracket means and in alignment with said traversing track as measured along said track whereby pulling on said end sections will unlock said track engaging means and move said bracket means along the track.

7. The improvement in a pleated shade assembly according to claim 6, wherein:

(a) the traversing track includes an upper guide track facing downwardly and a lower guide track facing upwardly; and (b) said track engaging means includes first and second slide members disposed between said upper and lower guide tracks and spaced from each other as measured in a direction along said track.

8. The improvement in a pleated shade assembly according to claim 1, wherein:

(a) the central section extends in movable relationship through said first support whereby said first support can be moved along said central section by exerting a moving force thereon in a direction toward or away from said second support.

9. The improvement in a pleated shade assembly according to claim 8, wherein:

(a) said shade guide means comprises a cord.

10. The improvement in a pleated shade assembly according to claim 9, wherein:

(a) the braking means for creating a braking force includes:

(1) first and second cord guide means located at least adjacent the upper and lower ends, respectively, of the first support for directing said first and second end sections of said cord away from said first support, and (2) tensioning means for holding said cord in tension between the first and second end sections thereof and in frictional engagement with said cord guide means.

11. The improvement in a pleated shade assembly according to claim 10, wherein:

(a) the tensioning means includes means for securing the terminal ends of the cord against movement relative-to each other with the cord extending in taut condition between the first and second end sections thereof.

12. The improvement in a pleated shade assembly according to claim 11, wherein:

(a) the first and second end sections of said cord are connected to each other to form a closed cord loop; and (b) one of said end sections is drivingly connected to a drive means for selectively moving said cord loop in clockwise and counterclockwise directions.

13. The improvement in a pleated shade assembly according to claim 12, wherein:

(a) said braking means for creating a braking force further includes:

(1) means for connecting said one end section of the cord to the drive means against movement independently of actuation of said drive means.

14. The improvement in a pleated shade assembly according to claim 10, wherein:

(a) the first end section of the cord extends away from said first end of said track along said track in a downwardly directed loop section and then back to said first end of said track and along said track with the terminal end thereof connected to said bracket means; and (b) the second end section of the cord extends from the lower end of the first support, through the lower end of the second support, out through the upper end of the second support and along said track with the terminal end thereof connected to said bracket means to form a closed cord loop.

15. The improvement in a pleated shade assembly according to claim 14, wherein:

(a) said tensioning means further includes means at the lower end of said downwardly directed loop section for maintaining the cord in said closed cord loop in tension.

16. The improvement in a pleated shade assembly according to claim 10, wherein:

(a) said tensioning means includes a tension spring connected to the cord to hold the cord in generally straight taut lines between:

(1) the upper and lower ends of the first support, (2) the upper end of the first support and the first end of said track, and (3) the lower end of the first support and the second support.

17. The improvement in a pleated shade assembly according to claim 16, wherein:

(a) the tension spring has one end connected to the second end section of the cord and its other end to the second support.

18. The improvement in a pleated shade assembly according to claim 17, wherein:

(a) the second end section of the cord extends from the lower end of the first support, through the lower end of the second support and toward the upper end thereof; and (b) said tension spring is disposed between the upper and lower ends of the second support.

19. The improvement in a pleated shade assembly according to claim 18, wherein:

(a) the second support includes an elongated housing extending between the upper and lower ends of the support;

(b) a stiffener strip attached to the opposite lateral end of the shade member, releasably secured to said housing and extending between the upper and lower ends thereof; and (c) said tension spring has one end connected to the second end section of the cord and its other end connected to said stiffener.

20. The improvement in a pleated shade assembly according to claim 1, wherein:

(a) the means for creating a braking force includes:

(1) a releasable brake handle connected to said first support and including a brake engageable with the central section of the shade guide means extending between the upper and lower ends of the first support to normally hold the first support against movement along said central section, and (2) brake releasing means connected between said handle and said brake for releasing said brake upon exerting said moving force on the handle.

21. The improvement in a pleated shade assembly according to any one of claims 1, 9–12 and 16–20, wherein:

(a) the traversing track includes an upper guide track facing downwardly and a lower guide track facing upwardly;

(b) said bracket means includes:

(1) a first section connected to the upper end of the first support, (2) a second section extending along the traversing track, and (3) first and second track engaging means on the second section of the bracket means, said first and second tracking engaging means being spaced from each other as measured in a direction along said track; and (c) the first and second end sections of said shade guide means extend away from the first support in opposite directions as measured along said track to urge said first support and bracket to pivot in the plane of said shade member and to bias said first track engaging means against the lower guide track of the traversing track and the second track engaging means against the upper guide track.

22. The improvement in a pleated shade assembly according to claim 21, wherein:

(a) the first track engaging means includes first roller means located adjacent the upper end of the first support; and (b) the second track engaging means includes second roller means located between the first roller means and the second support.

23. The improvement in a pleated shade assembly according to claim 22, wherein:

(a) the upper and lower guide tracks each include side guides for constraining lateral movement of said roller means as they move along the guide tracks between said first and second positions.

24. The improvement in a pleated shade assembly according to any one of claims 2, 10 and 16, wherein:

(a) the tensioning means includes a tension adjuster for adjusting the tension thereof.

25. The improvement in a pleated shade assembly according to claim 24, wherein:

(a) the tension adjuster includes:

(1) a tension adjuster track section extending along the traversing track, and (2) a connector means mounted in said track section for selective movement therealong and connected to the terminal end of the shade guide means at the first end section thereof to selectively locate said terminal end at different locations along the track section to vary the tension in said tensioning means.

26. The improvement in a pleated shade assembly according to claim 25, wherein:

(a) the tension adjuster track section is located adjacent the first position along the traversing track.

27. The improvement in a pleated shade assembly according to claim 1, wherein:

(a) the pleated shade is a honeycomb cell structure having a natural tendency to collapse the cells to said retracted condition of the shade.

28. The improvement in a pleated shade assembly according to claim 1, further including:

(a) means for movably supporting the upper end of the shade member from said traversing track independently of said bracket means.

29. The improvement in a pleated shade assembly according to claim 1, wherein:

(a) the lower end of said shade member is free of structure other than said shade guide means intermediate said first and second supports.

* * * * *